US006404300B2

(12) United States Patent
Ishida

(10) Patent No.: US 6,404,300 B2
(45) Date of Patent: Jun. 11, 2002

(54) MICROWAVE MODULE FOR SEPARATING HIGH FREQUENCY TRANSMISSION SIGNALS AND HIGH FREQUENCY RECEPTION SIGNALS ON THE BASIS OF THEIR FREQUENCIES

(75) Inventor: Masaaki Ishida, Kawasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/803,959

(22) Filed: Mar. 13, 2001

(30) Foreign Application Priority Data

Jun. 21, 2000 (JP) ..... 2000-186446

(51) Int. Cl.[7] ..... H01P 1/213
(52) U.S. Cl. ..... 333/135; 333/134
(58) Field of Search ..... 333/135, 134; 455/73

(56) References Cited

U.S. PATENT DOCUMENTS 5,923,229 A * 7/1999 Simons ..... 333/135
6,041,219 A 3/2000 Peterson
6,064,862 A * 5/2000 Grenon et al. ..... 455/73
6,072,991 A * 6/2000 Paul et al. ..... 455/73

FOREIGN PATENT DOCUMENTS

EP 0 231 422 8/1987
JP 4-151903 * 5/1992 ..... H01P/5/107

* cited by examiner

*Primary Examiner*—Robert Pascal
*Assistant Examiner*—Dean Takaoka
(74) *Attorney, Agent, or Firm*—Oblon, Spivak, McClelland, Maier & Neustadt, P.C.

(57) ABSTRACT

A waveguide for separating a high-frequency transmission signal and a high-frequency reception signal on the basis of their frequencies is formed in a diplexer. Further, a transmission-side connection port, a reception-side connection port and an antenna connection port are formed in peripheral portions of the diplexer such that the ports communicate with the waveguide. A circuit section including a high-frequency transmission circuit, a high-frequency reception circuit, and direct-current circuits are mounted on one side of the diplexer. The high-frequency transmission circuit is connected to the transmission-side connection port of the diplexer, and the high-frequency reception circuit is connected to the reception-side connection port of the diplexer.

16 Claims, 4 Drawing Sheets

MICROWAVE MODULE FOR SEPARATING HIGH FREQUENCY TRANSMISSION SIGNALS AND HIGH FREQUENCY RECEPTION SIGNALS ON THE BASIS OF THEIR FREQUENCIES

CROSS-REFERENCE TO RELATED APPLICATIONS

This application is based upon and claims the benefit of priority from the prior Japanese Patent Application No. 2000-186446, filed Jun. 21, 2000, the entire contents of which are incorporated herein by reference.

BACKGROUND OF THE INVENTION

The present invention relates to a microwave module for use in, for example, a telecommunication apparatus or a radar apparatus, etc.

In general, a microwave module of this type has a shield structure as shown in FIG. 1, which comprises a metal case 1, and a circuit board 2 thermally connected thereto and received therein. The circuit board 2 has a high-frequency transmission circuit, a high-frequency reception circuit and a DC circuit, such as a power supply or an oscillation circuit, mounted thereon. The metal case 1 has a transmission-side waveguide connection port 3 and a reception-side waveguide connection port 4 formed therein. The transmission-side connection port 3 and the reception-side connection port 4 are connected to the connection terminals of the high-frequency transmission circuit and the high-frequency reception circuit on the circuit board 2 in the metal case 1, respectively, via their respective waveguide conversion members (not shown) called "waveguide conversion probes".

Further, the transmission-side connection port 3 and the reception-side connection port 4 of the metal case 1 are connected to a transmission-side connection port 6 and a reception-side connection port 7 incorporated in a waveguide-type diplexer 5 for separating a high-frequency transmission signal and a high-frequency reception signal on the basis of their frequencies. The diplexer 5 also has an antenna connection port 8 to be connected to an antenna connection port (not shown) for signal transmission and reception, thereby constituting a desired telecommunication system.

In the above microwave module, however, the waveguide-type diplexer 5 attached to the metal case inevitably projects therefrom, since the transmission-side connection port 6 and the reception-side connection port 7 of the diplexer 5 must be respectively connected to the transmission-side connection port 3 and the reception-side connection port 4 of the metal case 1. This means that the module is large in size and hence requires a large installation space.

The problem of how to reduce the required installation space of the module is one of important problems that must be solved to satisfy the recent demand to downsize telecommunication devices and radar devices.

BRIEF SUMMARY OF THE INVENTION

It is the object of the invention to provide a compact microwave module of a simple structure capable of accurately separating high-frequency signals on the basis of their frequencies.

To attain the object, there is provided a microwave module comprising: a diplexer made of a conductive material, having a waveguide formed therein for separating a high-frequency transmission signal and a high-frequency reception signal on the basis of their frequencies, and having a transmission-side connection port, a reception-side connection port and an antenna connection port formed in peripheral portions of the diplexer such that the ports communicate with the waveguide; and a circuit section thermally connected to one side of the diplexer and grounded via the diplexer, the circuit section including a high-frequency transmission circuit connected to the transmission-side connection port, a high-frequency reception circuit connected to the reception-side connection port, and a direct-current circuit.

In the above structure, the diplexer executes its intrinsic function of separating, on the basis of frequency, a high-frequency transmission signal to be transmitted to the high-frequency transmission circuit of the circuit section provided on the one side of the diplexer, and a high-frequency reception signal received via the high-frequency reception circuit of the circuit section. The diplexer also functions as a base plate for earthing the circuit section and for executing its thermal control.

Since, thus, the diplexer has both the earthing function and the thermal control function, the module can be made by a smaller number of component parts. Further, the module has a stacked structure in which the circuit section is mounted on one side of the diplexer. By virtue of this structure, the module can be made compact.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiment of the invention will be described with reference to the accompanying drawings.

Figure 1:
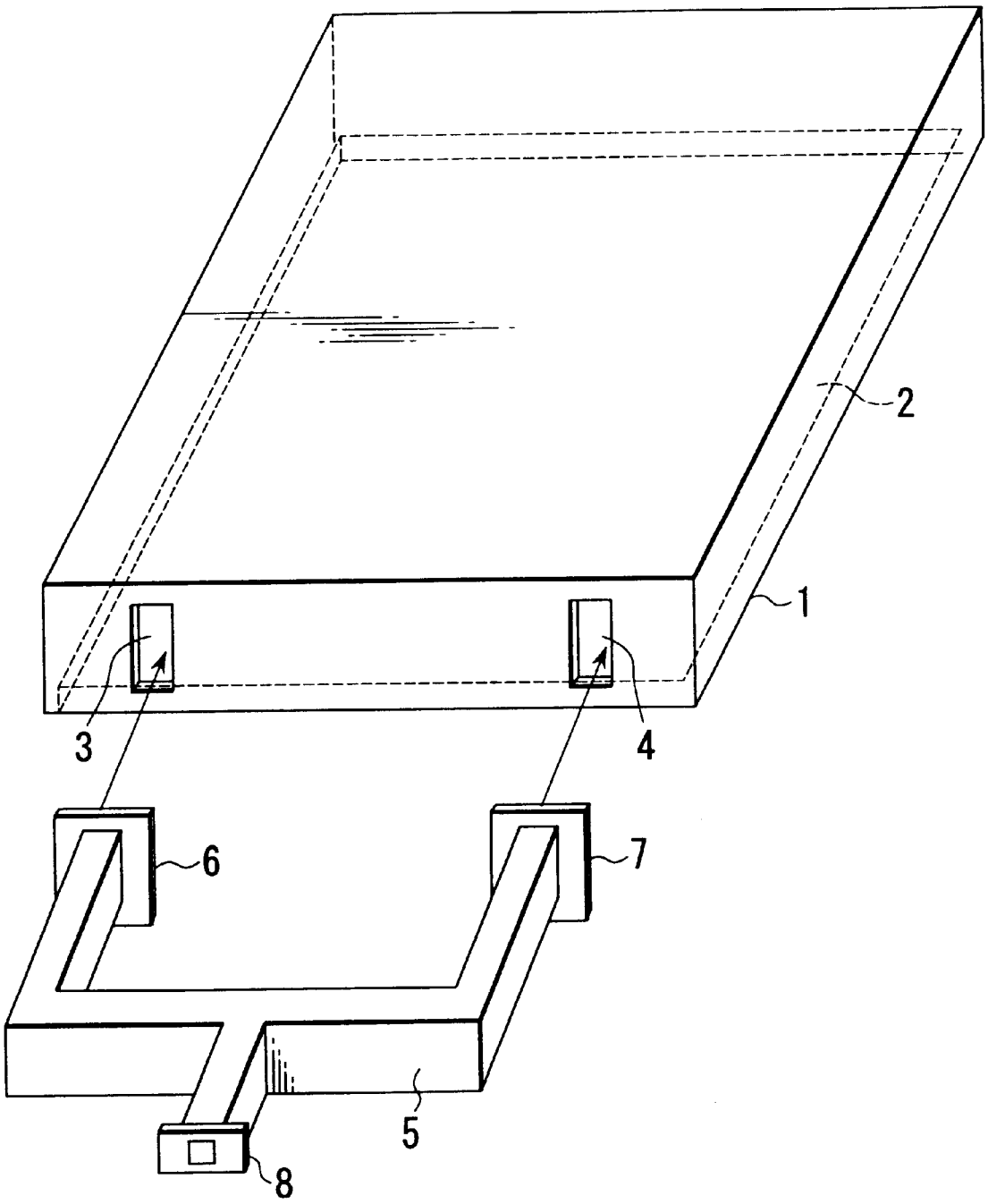
FIG. 1 (PRIOR ART)
FIG. 1 is an exploded perspective view illustrating a conventional microwave module.
Figure 2:
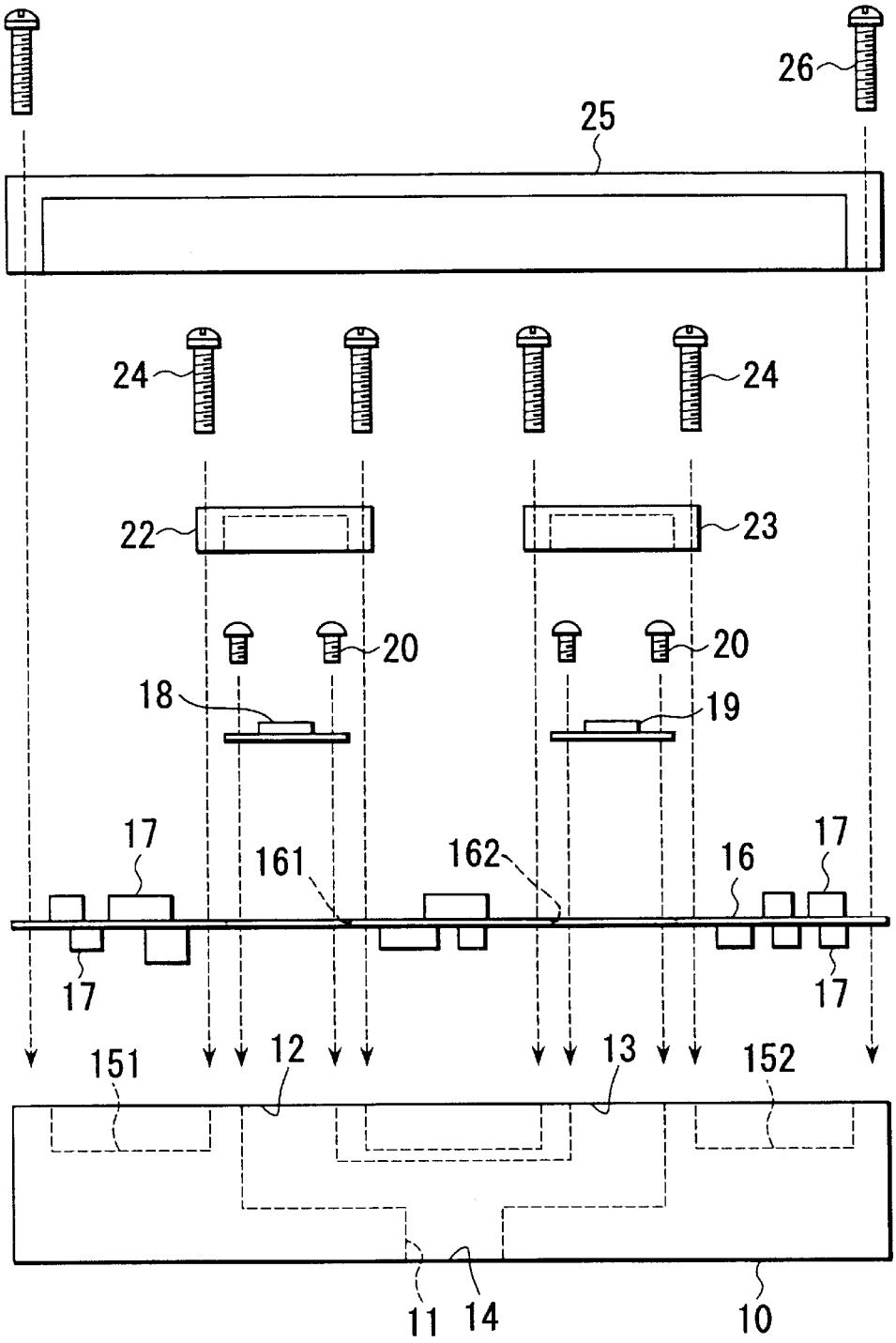
FIG. 2 is an exploded view illustrating a microwave module according to the embodiment of the invention.
Figure 3:
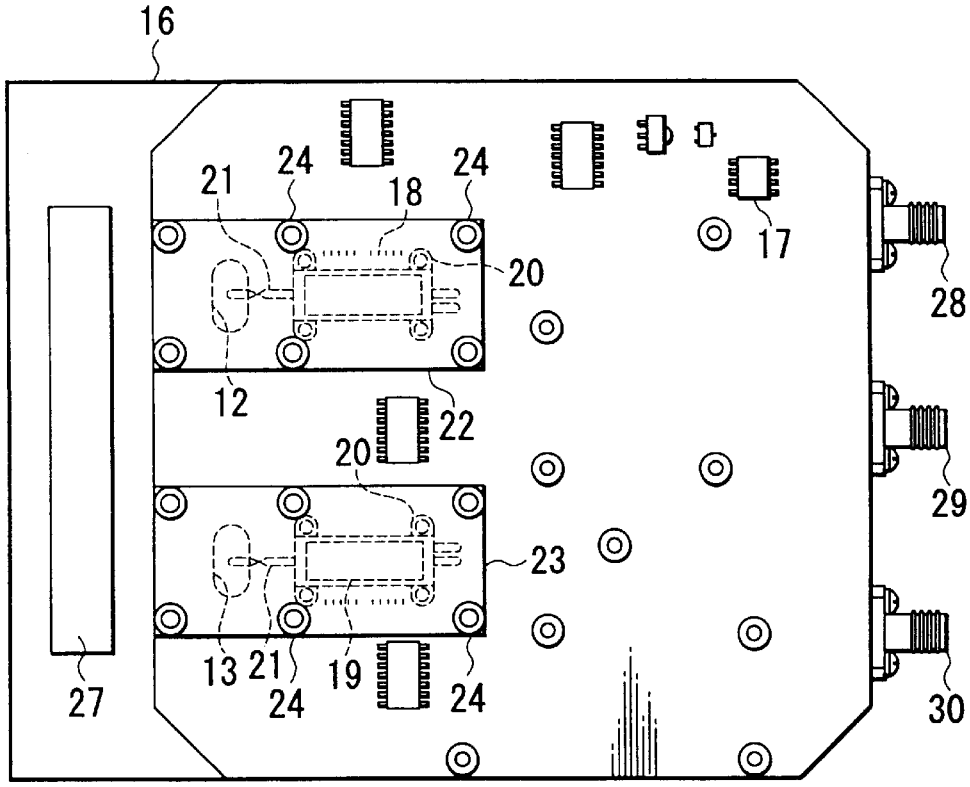
FIG. 3 is a plan view illustrating a structure, viewed from above, obtained when the component parts shown in FIG. 2 are assembled.
Figure 4:
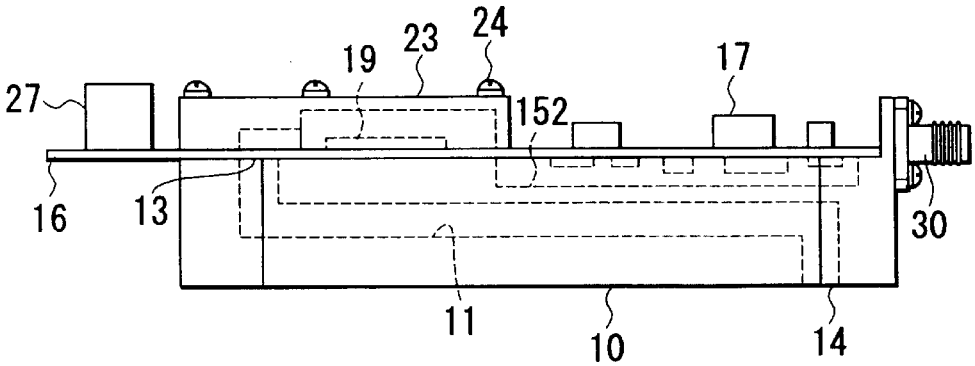
FIG. 4 is a side view illustrating the structure obtained when the component parts shown in FIG. 2 are assembled.
Figure 5:
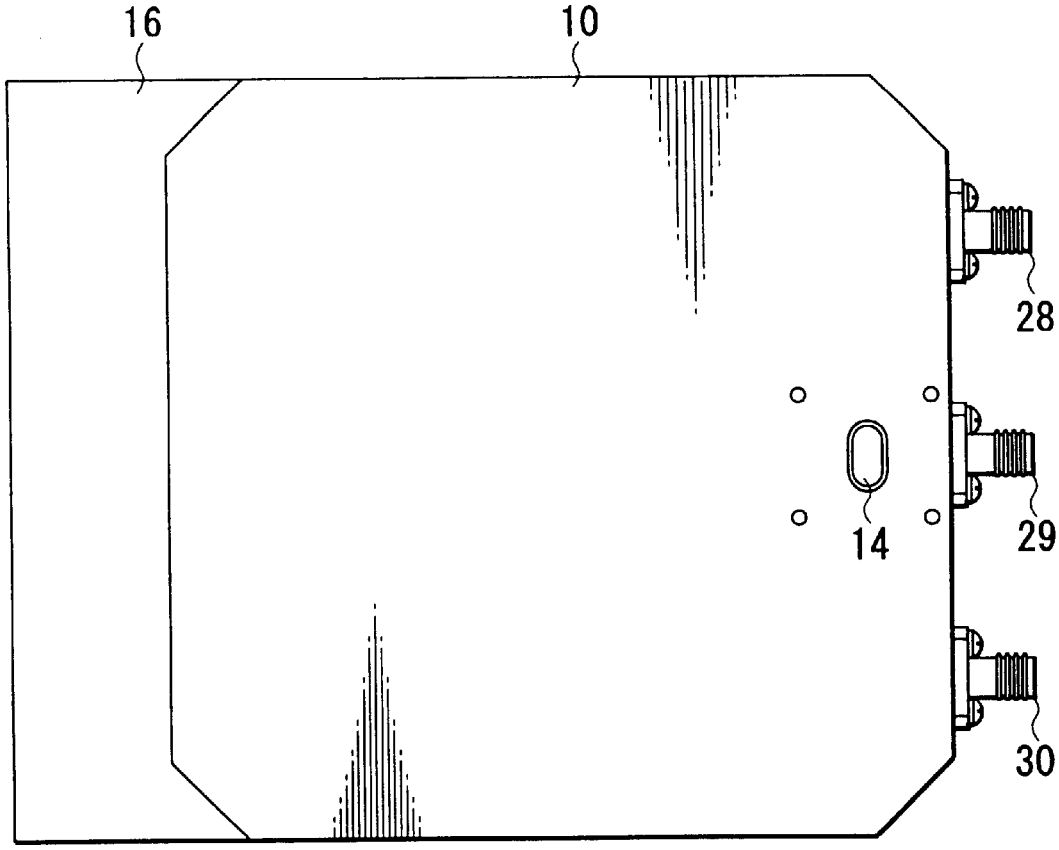
FIG. 5 is a plan view illustrating a structure, viewed from below, obtained when the component parts shown in FIG. 2 are assembled.

FIGS. 2–5 show a microwave module according to the embodiment of the invention. FIG. 2 shows a pre-assembly state. FIG. 3 shows an assembled state viewed from above. FIG. 4 is a lateral view of the assembled state. FIG. 5 shows an assembled state viewed from below.

A diplexer 10, which features the present invention, is formed of a substantially tabular member made of a conductive material, e.g. a metal such as aluminum. The diplexer 10 constitutes a board-attaching base plate, and has a waveguide 11 formed therein for separating a high-frequency transmission signal and a high-frequency reception signal on the basis of their frequencies.

A transmission-side waveguide connection port 12 and a reception-side waveguide connection port 13, which communicate with the waveguide 11, are provided at one side of the diplexer 10. An antenna connection port 14 is provided at the other side of the diplexer 10. With this structure, the diplexer 10 guides a high-frequency transmission signal input through the transmission-side connection port 12, to the antenna connection port 14 via the waveguide 11, and guides a high-frequency reception signal input through the antenna connection port 14, to the reception-side connection port 13 via the waveguide 11.

Circuit receiving recesses 151 and 152 are provided on the aforementioned one side of the diplexer 10, corresponding, for example, to the transmission-side waveguide connection port 12 and the reception-side waveguide connection port 13, respectively. A circuit board 16 that constitutes a circuit section is mounted on the one side of the diplexer 10, with circuit elements of the board received in the recesses. Thus, an earthing surface as one surface of the circuit board 16 is mounted on the one side of the diplexer 10, whereby the board 16 is electrically and thermally connected to the diplexer 10.

Further, DC circuits 17, such as a power supply circuit and intermediate frequency (IF) circuits, etc., are provided on both opposite surfaces of the circuit board 16.

As aforementioned, the circuit board 16 is attached to the one side of the diplexer 10, with some DC circuits 17 on the earthing surface of the board received in the circuit-receiving recesses 151 and 152. This structure enables the DC circuits 17 to be mounted on the circuit board 16 with a high density, and also to be thermally controlled.

Moreover, in the above structure, a transmission-side IF circuit and a reception-side IF circuit are received in different receiving recesses. As a result, the transmission-side circuit and the reception-side circuit are sufficiently isolated from each other.

The circuit board 16 also has a high-frequency transmission circuit receiving hole 161 and a high-frequency reception circuit receiving hole 162 formed therein corresponding to the DC circuits 17. The high-frequency transmission circuit receiving hole 161 and the high-frequency reception circuit receiving hole 162 in the circuit board 16 are opposed to package attachment recesses 101 and 102 formed in the diplexer 10.

Figure 6:
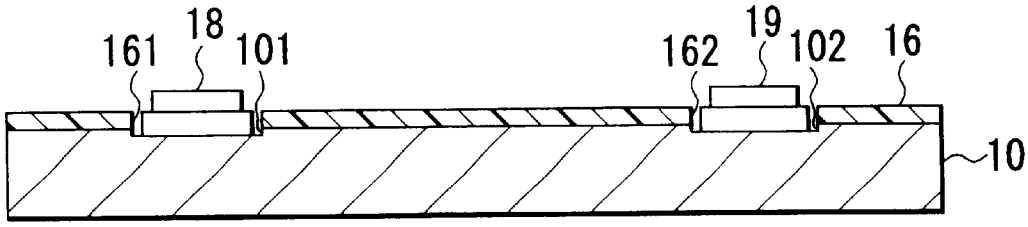
FIG. 6 is a sectional view useful in explaining an essential part of the module in detail.

Package-type high-frequency transmission circuit 18 and high-frequency reception circuit 19, which are formed of, for example, packaged semiconductor chips, are received in the respective package attachment recesses 101 and 102 through the high-frequency transmission circuit receiving hole 161 and the high-frequency reception circuit receiving hole 162, respectively (see FIG. 6). The high-frequency transmission circuit 18 and the high-frequency reception circuit 19 are secured to the package attachment recesses 101 and 102 by means of screws 20.

The high-frequency transmission circuit 18 and high-frequency reception circuit 19 are respectively connected to the transmission-side waveguide connection port 12 and the reception-side waveguide connection port 13 of the diplexer 10 by respective waveguide conversion members 21 called "waveguide conversion probes" (see FIG. 3). As a result, the high-frequency transmission circuit 18 and the high-frequency reception circuit 19 are thermally connected to the diplexer 10, and grounded via the diplexer 10. Accordingly, these circuits can be thermally controlled with high accuracy.

Conductive lids 22 and 23 are attached to the circuit board 16 by means of screws 24 such that they cover the high-frequency transmission circuit 18 and the high-frequency reception circuit 19 received in the package attachment recesses 101 and 102 of the diplexer 10, and further cover the transmission-side waveguide connection port 12 and the reception-side waveguide connection port 13 of the diplexer 10. The conductive lids 22 and 23 electromagnetically shield the high-frequency transmission circuit 18 and the high-frequency reception circuit 19, respectively, which are thermally connected to the diplexer 10.

In addition, a cover member 25 is provided on the diplexer 10 such that it covers the circuit board 16, and the conductive lids 22 and 23 that are respectively provided on the high-frequency transmission circuit 18 and the transmission-side connection port 12 of the diplexer 10, and on the high-frequency reception circuit 19 and the reception-side connection port 13 of the diplexer 10. The cover member 25 is attached to the diplexer 10 by means of screws 26.

In FIGS. 3–5, reference numeral 27 denotes an external connector to be connected to, for example, a power supply, reference numeral 28 a transmission-side intermediate frequency signal input terminal, reference numeral 29 a reference signal input terminal, and reference numeral 30 a reception-side intermediate frequency signal input terminal.

As described above, in the microwave module of the present invention, the waveguide 11 for separating a high-frequency transmission signal and a high-frequency reception signal on the basis of their frequencies is formed in the diplexer 10, and the transmission-side waveguide connection port 12, the reception-side waveguide connection port 13 and the antennal connection port 14 are formed in the diplexer 10 around the waveguide 11. Further, a circuit section including the high-frequency transmission circuit 18 connected to the transmission-side connection port 12, the high-frequency reception circuit 19 connected to the reception-side connection port 13, and the CD circuits 17 is mounted on one side of the diplexer 10.

By virtue of this structure, the diplexer 10 executes its intrinsic function of separating, on the basis of frequency, a high-frequency transmission signal to be transmitted to the high-frequency transmission circuit 18, and a high-frequency reception signal received via the high-frequency reception circuit 19. The diplexer 10 also functions as a base plate for earthing the circuit section and for executing its thermal control. Accordingly, the number of component parts of the module is reduced.

Moreover, the stacked structure in which the circuit board 16, the high-frequency transmission circuit 18 and the high-frequency reception circuit 19 are mounted on one side of the diplexer 10 enables the module to be made more compact.

Thus, the microwave module of this invention realizes the function of accurately separating a high-frequency transmission signal and a high-frequency reception signal on the basis of their frequencies, and also satisfies the need of reducing the necessary installation space in telecommunication devices and radar devices, etc., thereby satisfying the demand to downsize the devices.

Furthermore, in the microwave module of the invention, the circuit receiving recesses 151 and 152, in which the high-frequency transmission circuit 18 and the high-frequency reception circuit 19 are received, are formed in one side of the diplexer 10.

This structure enables a highly-integrated circuit section to be mounted on the diplexer 10. Further, since the high-frequency transmission circuit 18 and the high-frequency reception circuit 19 are received in the circuit receiving recesses 151 and 152, they can be sufficiently isolated from each other.

Although, in the above-described embodiment, the circuit board 16 is mounted on the tabular diplexer 10, the invention is not limited to this. The circuit board may be mounted on diplexers of various shapes having a waveguide formed therein.

Further, although, in the above-described embodiment, the packaged high-frequency transmission circuit 18 and high-frequency reception circuit 19 are directly mounted on the diplexer 10, and the circuit board 16, on which the DC circuits 17 are provided, is mounted on one side of the diplexer 10, the invention is not limited to this structure, but may be modified such that the high-frequency transmission circuit 18, the high-frequency reception circuit 19 and the DC circuits 17 are formed on the circuit board 16.

In addition, although, in the above-described embodiment, the diplexer 10 has a plurality of circuit receiving recesses (151, 152), in which some of the DC circuits 17 provided on the other side of the circuit board 16 are received, the invention is not limited to this. For example, the diplexer 10 may have a single circuit receiving recess formed therein for receiving some of the DC circuits 17 of the circuit board 16.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A microwave module comprising:

a diplexer made of a conductive material, having a waveguide formed therein for separating a high-frequency transmission signal and a high-frequency reception signal on the basis of their frequencies, having a transmission-side connection port, a reception-side connection port and an antenna connection port formed in peripheral portions of the diplexer such that the ports communicate with the waveguide; and having an exterior circuit-mounting surface provided at the peripheral portions of the diplexer in which the transmission-side connection port and the reception-side connection port are formed; and a circuit section directly mounted on the exterior circuit-mounting surface of the diplexer such that the circuit section is grounded by and thermally connected to the diplexer, the circuit section including a high-frequency transmission circuit connected to the transmission-side connection port, a high-frequency reception circuit connected to the reception-side connection port, and a direct-current circuit.

2. The microwave module according to claim 1, wherein the high-frequency transmission circuit and the high-frequency reception circuit are respectively connected to the transmission-side connection port and the reception-side connection port of the diplexer via respective waveguide conversion members.

3. The microwave module according to claim 1, wherein the diplexer is tabular, and has the one side thereof provided with the transmission-side connection port and the reception-side connection port, and the other side thereof provided with the antenna connection port.

4. The microwave module according to claim 3, wherein the high-frequency transmission circuit and the high-frequency reception circuit are respectively connected to the transmission-side connection port and the reception-side connection port of the diplexer via respective waveguide conversion members.

5. The microwave module according to claim 1, further comprising conductive cover members individually covering the high-frequency transmission circuit, the high-frequency reception circuit and the direct-current circuit, which are directly mounted on the exterior circuit-mounting surface of the diplexer, the conductive cover members and the diplexer being joined to electromagnetically shield the respective circuits.

6. The microwave module according to claim 5, wherein the high-frequency transmission circuit and the high-frequency reception circuit are respectively connected to the transmission-side connection port and the reception-side connection port of the diplexer via respective waveguide conversion members.

7. The microwave module according to claim 5, wherein the diplexer is tabular, and has the one side thereof provided with the transmission-side connection port and the reception-side connection port, and the other side thereof provided with the antenna connection port.

8. The microwave module according to claim 7, wherein the high-frequency transmission circuit and the high-frequency reception circuit are respectively connected to the transmission-side connection port and the reception-side connection port of the diplexer via respective waveguide conversion members.

9. The microwave module according to claim 1, wherein the exterior circuit-mounting surface of the diplexer has circuit-receiving recesses in which at least parts of the circuit section are received.

10. The microwave module according to claim 9, wherein the high-frequency transmission circuit and the high-frequency reception circuit are respectively connected to the transmission-side connection port and the reception-side connection port of the diplexer via respective waveguide conversion members.

11. The microwave module according to claim 9, wherein the diplexer is tabular, and has the one side thereof provided with the transmission-side connection port and the reception-side connection port, and the other side thereof provided with the antenna connection port.

12. The microwave module according to claim 11, wherein the high-frequency transmission circuit and the high-frequency reception circuit are respectively connected to the transmission-side connection port and the reception-side connection port of the diplexer via respective waveguide conversion members.

13. The microwave module according to claim 9, further comprising conductive cover members individually covering the high-frequency transmission circuit, the high-frequency reception circuit and the direct-current circuit, which are directly mounted on the exterior circuit-mounting surface of the diplexer, the conductive cover members and the diplexer being joined to electromagnetically shield the respective circuits.

14. The microwave module according to claim 13, wherein the high-frequency transmission circuit and the high-frequency reception circuit are respectively connected to the transmission-side connection port and the reception-side connection port of the diplexer via respective waveguide conversion members.

15. The microwave module according to claim 13, wherein the diplexer is tabular, and has the one side thereof provided with the transmission-side connection port and the reception-side connection port, and the other side thereof provided with the antenna connection port.

16. The microwave module according to claim 15, wherein the high-frequency transmission circuit and the high-frequency reception circuit are respectively connected to the transmission-side connection port and the reception-side connection port of the diplexer via respective waveguide conversion members.

* * * * *